US012313085B1

(12) United States Patent
Li

(10) Patent No.: US 12,313,085 B1
(45) Date of Patent: May 27, 2025

(54) CONNECTION COMPONENT AND FAN

(71) Applicant: LEMOISTAR TECHNOLOGY (SHENZHEN) CO., LTD., Shenzhen (CN)

(72) Inventor: Jinpeng Li, Shenzhen (CN)

(73) Assignee: LEMOISTAR TECHNOLOGY (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/638,410

(22) Filed: Apr. 17, 2024

Related U.S. Application Data

(63) Continuation of application No. PCT/CN2024/079395, filed on Feb. 29, 2024.

(30) Foreign Application Priority Data

Feb. 8, 2024 (CN) ..... 202420290504.0

(51) Int. Cl.
*F04D 29/64* (2006.01)

(52) U.S. Cl.
CPC ..... *F04D 29/644* (2013.01)

(58) Field of Classification Search
CPC ..... F04D 19/002; F04D 25/10; F04D 25/105; F04D 29/60; F04D 29/601; F04D 29/626; F04D 29/628; F04D 29/644; F04D 29/646; F16C 2360/46
See application file for complete search history.

(56) References Cited

U.S. PATENT DOCUMENTS

| | | | | |
|---|---|---|---|---|
| 5,018,951 | A * | 5/1991 | Wang | F04D 29/646 16/DIG. 30 |
| 5,431,544 | A * | 7/1995 | Hsu | F04D 29/601 248/676 |
| 6,244,823 | B1 * | 6/2001 | Marino | F04D 29/601 416/246 |
| 10,724,529 | B2 * | 7/2020 | Lin | F04D 29/646 |
| 11,162,513 | B2 * | 11/2021 | Cen | F04D 25/105 |
| 2004/0037704 | A1 * | 2/2004 | Cichetti, Sr. | F16M 11/10 416/246 |
| 2019/0264698 | A1 * | 8/2019 | Parel | F04D 25/084 |
| 2022/0372985 | A1 * | 11/2022 | Cui | F16C 11/045 |

* cited by examiner

*Primary Examiner* — Eric J Zamora Alvarez
(74) *Attorney, Agent, or Firm* — JEEN IP LAW, LLC

(57) ABSTRACT

A connection component for a fan and a fan are provided, the connection component includes a first interface component including a first housing and an actuator accommodated within the first housing, the actuator is configured to connect to a bracket of the fan and capable of rotating along a first axis relative to the first housing; a second interface component including a second housing configured to connect to a fan head; and a rotation mechanism including a first mechanism and a second mechanism that can rotate with each other along a second axis. The second axis is perpendicular to the first axis, the first mechanism is rotationally and fixedly connected to the first interface component, the second mechanism is rotationally and fixedly connected to the second interface component, so that the first interface component and the second interface component can rotate with each other along the second axis.

13 Claims, 17 Drawing Sheets

B-B

CONNECTION COMPONENT AND FAN

CROSS-REFERENCE TO RELATED APPLICATIONS

This application claims priority to Chinese Patent Application No. 202420290504.0, filed on Feb. 8, 2024, and PCT/CN2024/079395, filed on Feb. 29, 2024, which are hereby incorporated by reference in its entirety.

TECHNICAL FIELD

The present disclosure relates to a connection component for a fan and a fan including the connection component.

BACKGROUND

Fan is a common type of household appliance product, which usually includes a fan head, a bracket, and a connection component that connects the two. In order to provide air supply in multi angles, the connection component usually has at least one degree of freedom for rotation.

Common floor standing fans include a large-sized bracket or a base, which results in a large overall dimension and poor flexibility of the fan. In some indoor or outdoor applications, portable, lightweight, and highly flexible fans are required, which requires the connection component to be able to simultaneously swing the head up and down (pitch) and left and right (swing).

It is known that the device for implementing a composite swing head usually uses two synchronous motors to drive two rotating axes respectively to achieve up and down swing and left and right swing. This structure has the disadvantages of high cost and easy damage. Besides that, the swing angle of these devices is limited, which results in a limited range of air supply for the fan.

Therefore, there is a need for a new type of connection component for a fan and a fan including such connection component, which can achieve up and down swing and left and right swing, with a large range of swing angles, simple structure, and compact size.

SUMMARY

In response to the problems and requirements mentioned above, the present disclosure proposes a new type of connection component for a fan and a fan, which solves the above problems and brings other technical effects due to adopting the following technical features.

In a first aspect, the present disclosure provides a connection component for a fan, which includes: a first interface component including a first housing and an actuator accommodated within the first housing, where the actuator is configured to connect to a bracket of the fan and capable of rotating relative to the first housing along a first axis; a second interface component including a second housing configured to connect a fan head of the fan; and a rotation mechanism including a first mechanism and a second mechanism that can rotate with each other along a second axis, the second axis is perpendicular to the first axis, where the first mechanism is rotationally and fixedly connected to the first interface component and the second mechanism is rotationally and fixedly connected to the second interface component so that the first interface component and the second interface component can rotate with each other along the second axis.

In some embodiments, the first mechanism and the second mechanism are arranged coaxially along the second axis, where the first mechanism includes a first friction disc, the first friction disc includes a first friction surface that is circumferentially distributed, the second mechanism includes a second friction disc, the second friction disc includes a second friction surface that is circumferentially distributed, the first friction surface and the second friction surface are in contact with each other and can rotate relative to each other along the second axis, where the first friction disc is rotationally and fixedly connected to the first housing, the second friction disc is rotationally and fixedly connected to the second housing.

In some embodiments, the first friction surface and the second friction surface are a planer surface, a frictional force between the first friction surface and the second friction surface allows the first friction disc and the second friction disc to maintain to be contacted at any angle; or the first friction surface and the second friction surface are a non-planar surface, the non-planar surface includes a tooth-shaped structure or a procyclicality curved surface.

In some embodiments, the first mechanism further includes an intermediate connector, which is fixedly connected with the first housing and rotationally and fixedly connected to the first friction disc.

In some embodiments, the second friction disc is provided with an angle limit portion on a surface opposite to the second friction surface, the angle limit portion protrudes from the surface and extends circumferentially; the angle limit portion has a first circumferential angle $\alpha 1$, the first mechanism further includes an angle limit member, which includes a main body and a sector portion extending along a circumference of the main body; the sector portion and the angle limit portion are arranged in a same plane; the main body is fixedly connected with the intermediate connector or the first friction disc; the sector portion has a second circumferential angle $\alpha 2$.

In some embodiments, a third circumferential angle $\alpha 3$ is formed between the angle limit portion and the sector portion in a first direction; a fourth circumference $\alpha 4$ is formed between the angle limit portion and the sector portion in a second direction opposite to the first direction; where the first circumference $\alpha 1$, second circumference $\alpha 2$, third circumference $\alpha 3$ and fourth circumference $\alpha 4$ satisfies the following relationship:

$$\alpha 1+\alpha 2+\alpha 3+\alpha 4=360°$$

where the third circumference $\alpha 3$ defines a maximum angle that the second mechanism can rotate relative to the first mechanism in the first direction, the fourth circumference angle $\alpha 4$ defines a maximum angle that the second mechanism can rotate relative to the first mechanism in the second direction.

In some embodiments, the third circumference angle $\alpha$ is within a range of 30° to 120°, the fourth circumference $\alpha 4$ is within a range of 10° to 90°.

In some embodiments, one of the first friction disc and the intermediate connector is provided with at least one first stop convex portion along a circumference, the other of the first friction disc and the intermediate connector is provided with at least one first stop concave portion that matches the at least one first stop convex portion along the circumference, and/or one of the second friction disc and the second housing is provided with at least one second stop convex portion along a circumference, the other of the second friction disc and the second housing is provided with at least one second stop concave portion that matches the at least one second stop convex portion along the circumference.

In some embodiment, the first housing is formed by enclosing two shell halves or forming a single piece as a whole.

In some embodiments, the first housing is in a shape of cylindrical, the connection component includes two rotation mechanisms, each rotation mechanism is provided at two opposite ends of the first housing, two ends of the second housing are rotationally and fixedly connected to the two rotation mechanisms, and the second housing is supported on the first housing by the two rotation mechanisms, the second housing includes an opening perpendicular to the second axis, the rotation mechanism passes through the opening along the second axis and is installed to the first housing and/or the second housing, the second interface component further includes a cover, the cover is clamping connection to the second housing and covers the opening.

In some embodiment, an elastic reset member is provided between the intermediate connector and the first friction disc, the elastic reset member applies a bias pressure on the first friction disc towards a direction of the second friction disc, or an elastic reset member is provided between the second friction disc and the second housing, the elastic reset member applies a bias pressure on the second friction disc towards a direction of the first friction disc.

In a second aspect, the present disclosure further provides a fan, which includes a fan head, a bracket, and the connection component, the bracket is connected to the first interface component, and the fan head is connected to the second interface component.

BRIEF DESCRIPTION OF DRAWINGS

In order to provide a clearer explanation of the technical solution of the disclosed embodiments, a brief introduction will be given below to the accompanying drawings of the embodiments. It is obvious that the accompanying drawings in the following description only relate to some embodiments of the present disclosure, rather than limiting the present disclosure.

DESCRIPTION OF EMBODIMENTS

Figure 1:
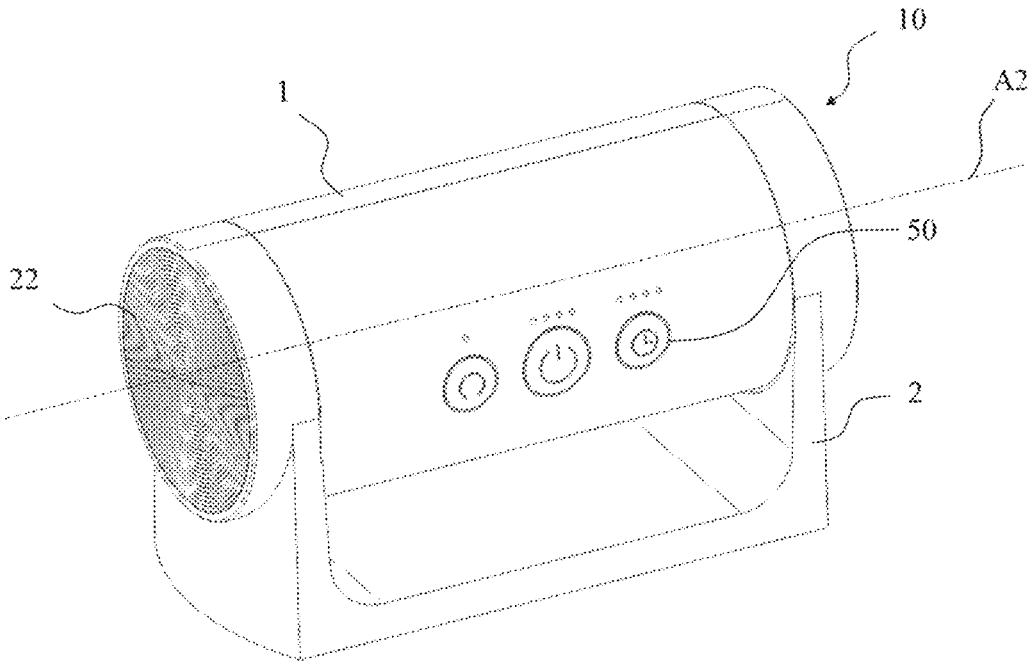
FIG. 1 is a perspective view of a connection component according to at least one embodiment of the present disclosure.

In order to render the purpose, technical solution, and advantages of the technical solution of the present disclosure clearer, the following will combine the drawings of the specific embodiments of the present disclosure to provide a clear and complete description of the technical solution of the embodiments of the present disclosure. The same number reference in the attached drawings represents the same member. It should be noted that the described embodiments are a part of the embodiments of the present disclosure, not the entire embodiments. Based on the embodiments herein of the present disclosure, all other embodiments obtained by those skilled in the art without the need for creative work fall within the protection scope of the present disclosure.

Unless otherwise defined, technical or scientific terms used herein shall have the usual meaning understood by those skilled in the art to which the present disclosure belongs. Terms "first", "second", and similar terms used in the present disclosure and claims do not indicate any order, number, or importance, but are only used to distinguish different components. Similarly, words like "a/an" or "the" do not necessarily indicate the number limit. Words such as "including" or "include" refer to components or objects that appear before the word, including those listed after the word and their equivalents, without excluding other components or objects. Words like "connection to" or "connection with" are not limited to physical or mechanical connections, but can include an electrical connection, whether direct or indirect. "Up", "down", "left", "right", etc. are only used to represent a relative positional relationship. When an absolute position of the described object changes, the relative positional relationship may also change accordingly.

It should be noted that term "rotationally and fixedly connection" referred to in the present disclosure refers to that two parts cannot rotate relative to each other along a rotation axis, but does not limit whether the two parts can make a relative motion along the rotation axis. The common ways to achieve the rotational and fixed connection include a shear key connection, a convex-to-concave fitting connection, or a non-circular shaft-to-hole connection. Of course, the fixed connection also includes in a scope of rotationally and fixed connection, because a relative rotation cannot occur when the two parts are completely fixed.

The following is a detailed explanation of the some embodiments of the connection component and the fan according to the present disclosure, combined with the accompanying drawings.

Compared with the embodiments shown in the accompanying drawings, feasible embodiments within the scope of the present disclosure may have fewer components, other components not shown in the drawings, different components, components arranged differently, or components connected differently. Furthermore, without departing from the concepts disclosed herein, two or more components in the drawings may be implemented in a single component, or the single component shown in the drawings may be implemented as multiple separate components.

Figure 26:
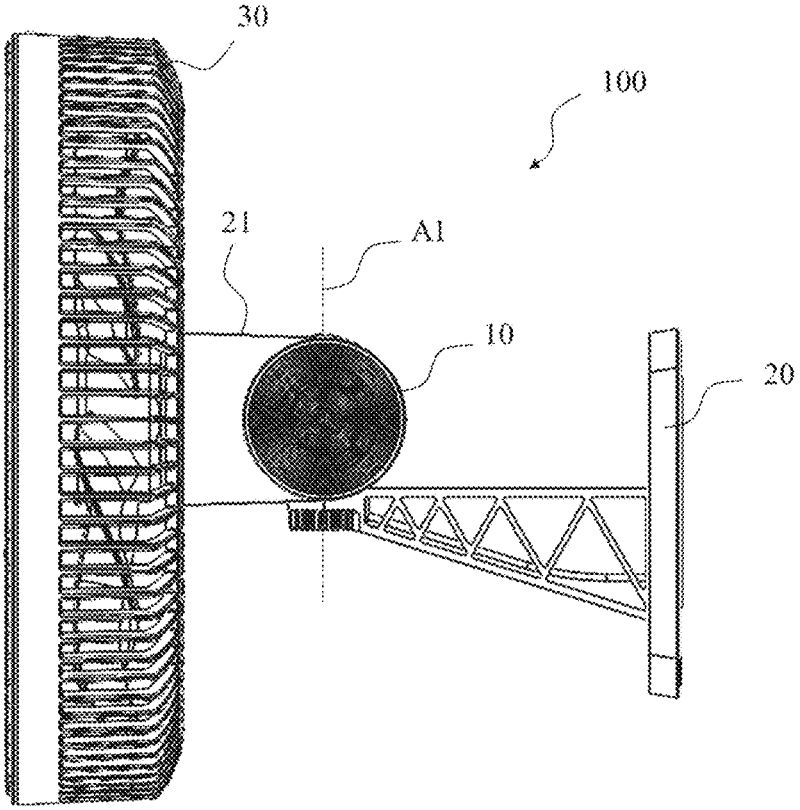
FIG. 26 is a side view of FIG. 25.

FIGS. 1 to 4 exemplarily illustrate a connection component 10 for a fan 100 according to at least one embodiment of the present disclosure, FIG. 26 exemplarily illustrates a fan 100 according to at least one embodiment of the present disclosure. As shown in FIGS. 1 to 4 and FIG. 26, the connection component 10 includes a first interface component 1, a second interface component 2, and a rotation mechanism 3. The first interface component 1 is configured to connect a bracket 20 of the fan 100, the second interface component 2 is configured to connect a fan head 30 of the fan 100.

For the fan 100, the fan head 30 can include a blade, a mesh cover, and a drive motor. The blade is provided in the mesh cover and connected to the drive motor, which drives the blades to rotate, thereby achieving air supply. The drive motor can be either an AC motor or a DC motor.

The bracket 20 includes a base 201 and a connection arm 202 extending from the base 201, the connection arm 202 is connected to the first interface component 1. In the embodiment shown in FIG. 26, the fan 100 can be a wall mounted fan, the base 201 can be joined to a wall or hung on an outdoor bracket. The bracket 20 shown in the present disclosure is only an example and not a limitation. The connection component 10 and the fan 100 proposed in the present disclosure can be applied to various types of fans, including but not limited to a vertical fan, a wall mounted fan, a rooftop fan, etc.

Figure 10:
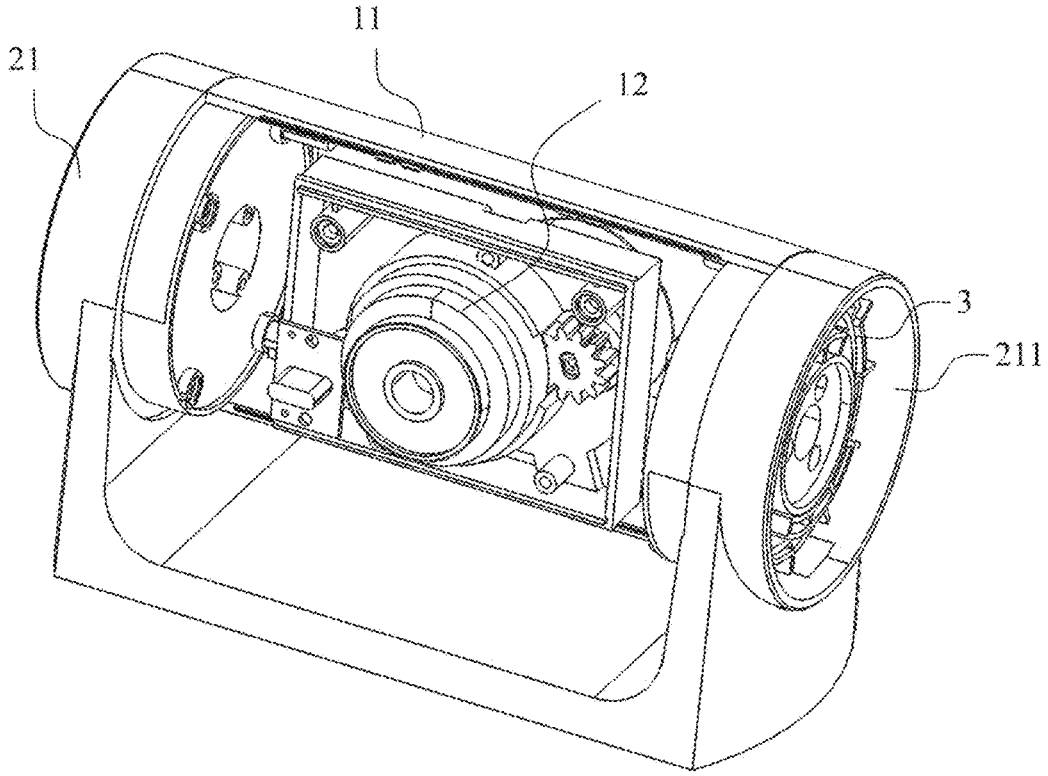
FIG. 10 is a perspective view of the connection component according to at least one embodiment of the present disclosure, where a cover and a shell half are omitted.
Figure 11:
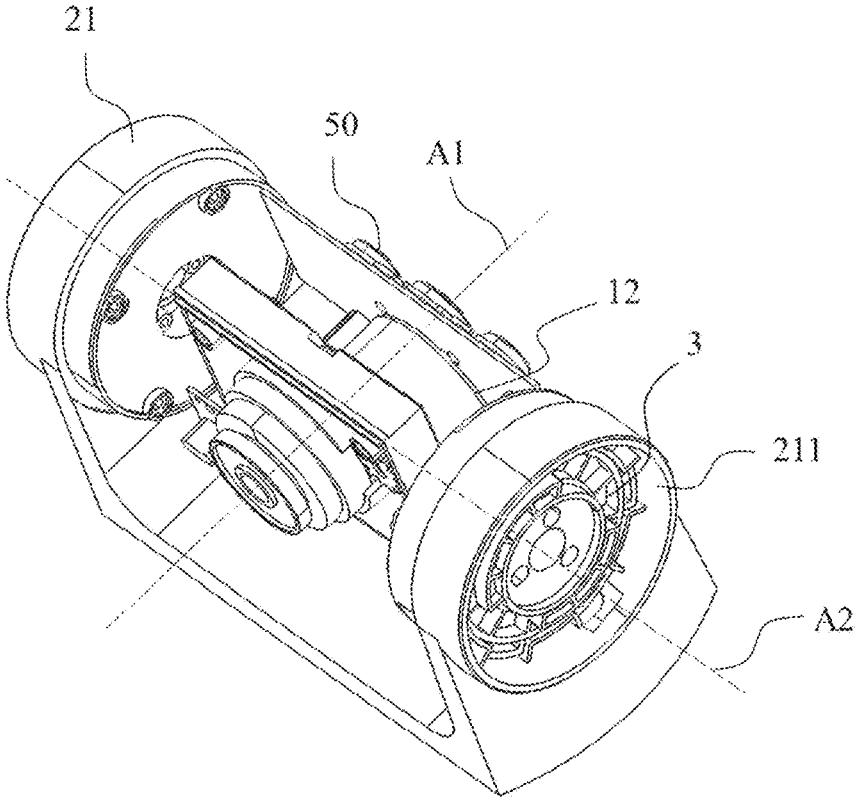
FIG. 11 is a perspective view of the connection component according to at least one embodiment of the present disclosure, where the cover and a first housing are omitted.
Figure 27:
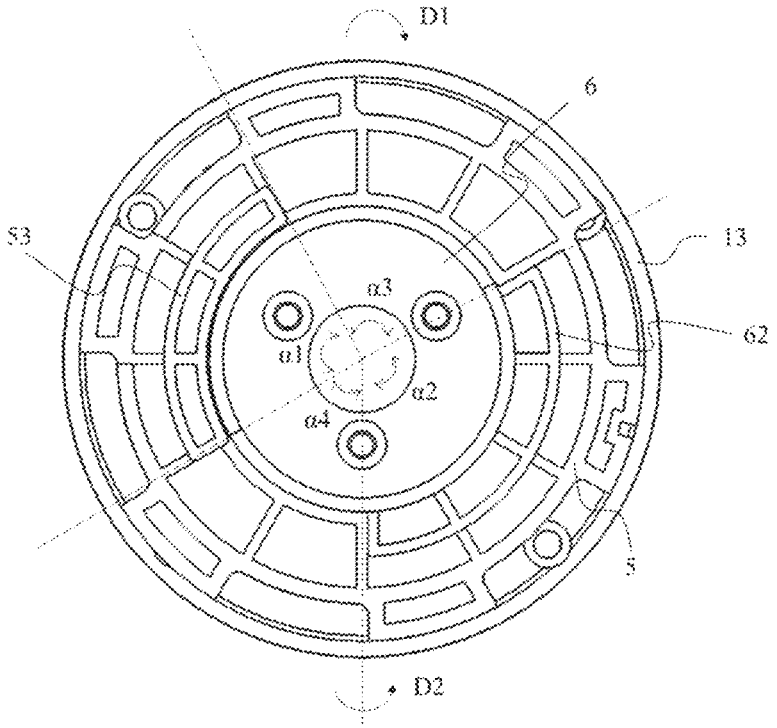
FIG. 27 is a schematic diagram of a relative position of the first mechanism and the second mechanism at the position shown in FIG. 26.

Furthermore, as shown in FIGS. 10 and 11, the first interface component 1 includes a first housing 11 and an actuator 12, the actuator 12 is accommodated within the first housing 11. The actuator 12 can be a conventional swing head motor assembly, including a motor, reducer, and output shaft, with a threaded installation hole on the output shaft for threaded connection with the connection arm 202 of the bracket 20. When the actuator 12 is working, the output shaft is driven to rotate. As the connection arm 202 is fixed, the first housing 11 can rotate relative to the bracket 20 along a first axis A1. As shown in FIG. 11, the first axis A1 is an axis along the output shaft of the actuator 12. After installation, as shown in FIG. 27, the first axis A1 is also an axis in a vertical direction. Therefore, the rotation of the actuator 12 relative to the first housing 11 can enable the fan head 30 to swing left and right in a horizontal plane relative to the bracket 20.

Figure 2:
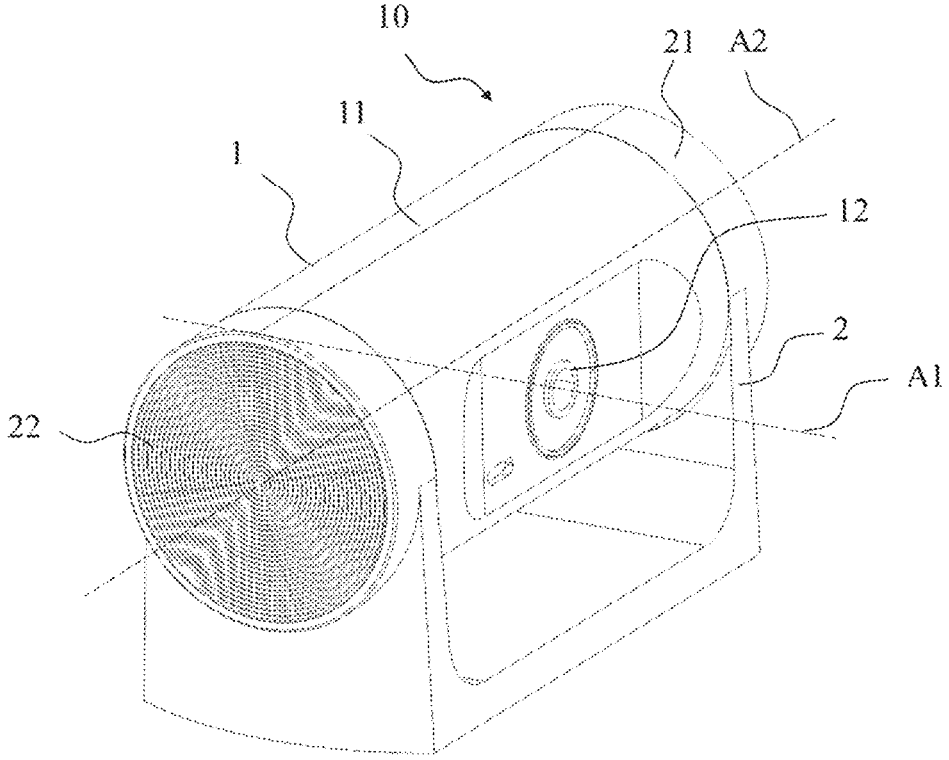
FIG. 2 is another perspective view of the connection component according to at least one embodiment of the present disclosure.

For example, in the embodiments shown in FIGS. 1 and 2, the first housing 11 may be formed by enclosing two shell halves.

For example, as shown in FIGS. 1 and 2, a button 50 can be provided on the first housing 11 to facilitate a user's control of start stop, air volume, or swing of the fan 100. A position of the button 50 can be adjusted according to an actual need, such as being provided at different positions on a side wall of the first housing 11. In the embodiments shown in FIGS. 1 and 2, the button 50 is provided on one of the shell halves.

Figure 25:
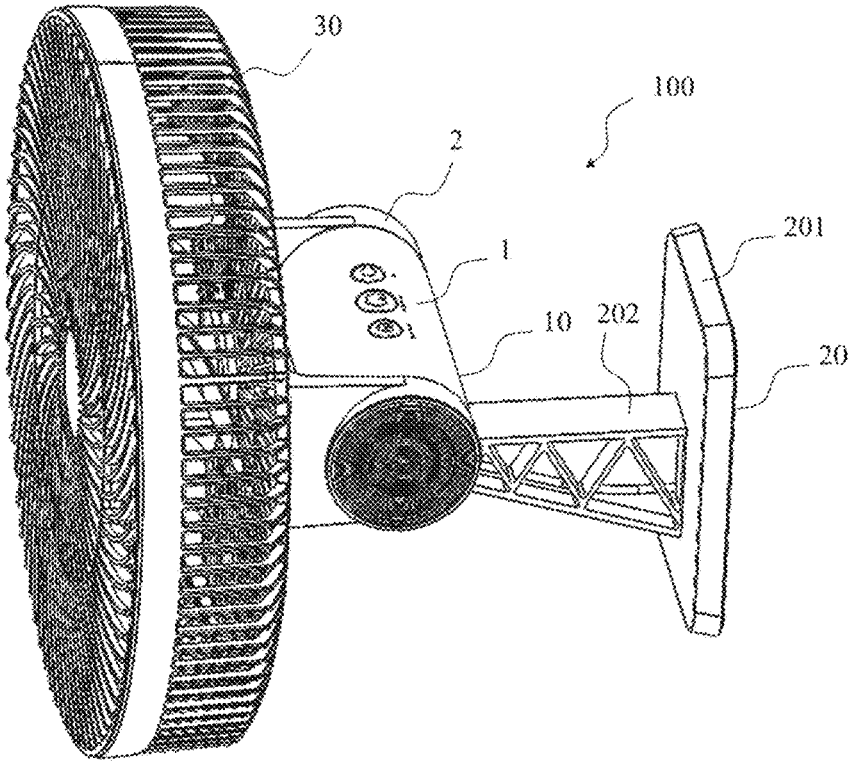
FIG. 25 is a perspective view of a fan according to at least one embodiment of the present disclosure, where the second interface component is located at its initial position.

In another embodiment shown in FIG. 25, the first housing 11 can be formed as a single piece, and the button 50 is provided above the first housing 11.

For example, as shown in FIG. 10, the first housing 11 has a roughly cylindrical shape, which includes a side wall and a hollow inner cavity, in which the actuator 12 is accommodated. Opposite two ends of the side wall are provided with an opening, each opening can be provided with a rotation mechanism 3. The connection component 10 can also include only one rotation mechanism 3, which is provided at one end of the first housing 11 and can be supported by a bearing at the other end. The connection component 10 can further include a larger number of rotation mechanisms 3, which are arranged to be coaxial with each other.

Figure 7:
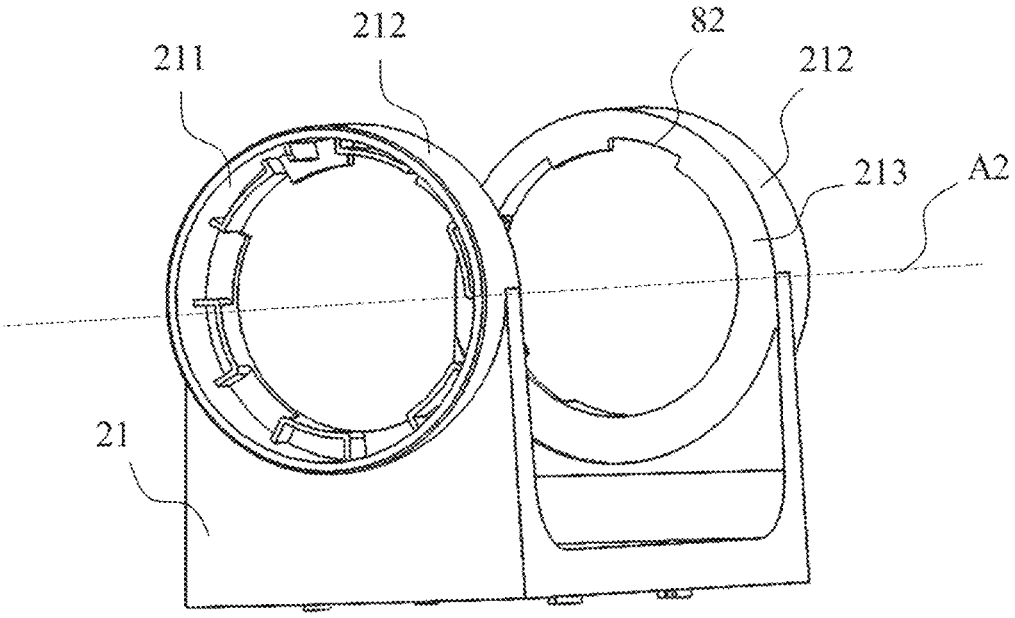
FIG. 7 is a perspective view of a second housing according to at least one embodiment of the present disclosure.
Figure 8:
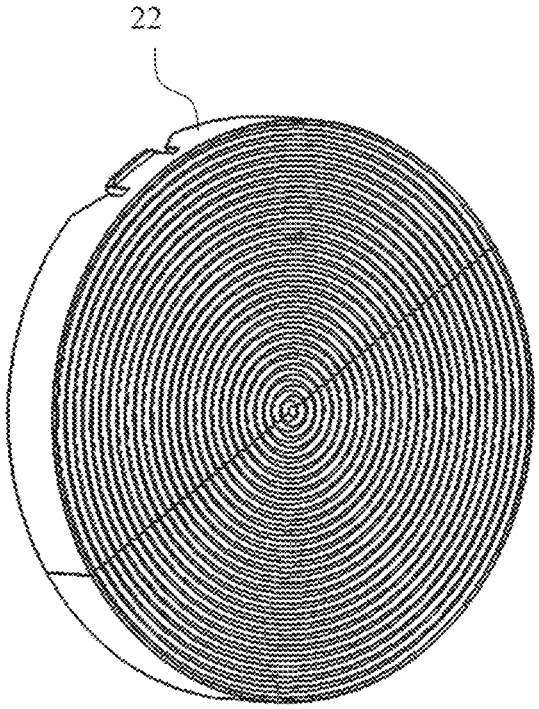
FIG. 8 is a perspective view of the cover according to at least one embodiment of the present disclosure.
Figure 9:
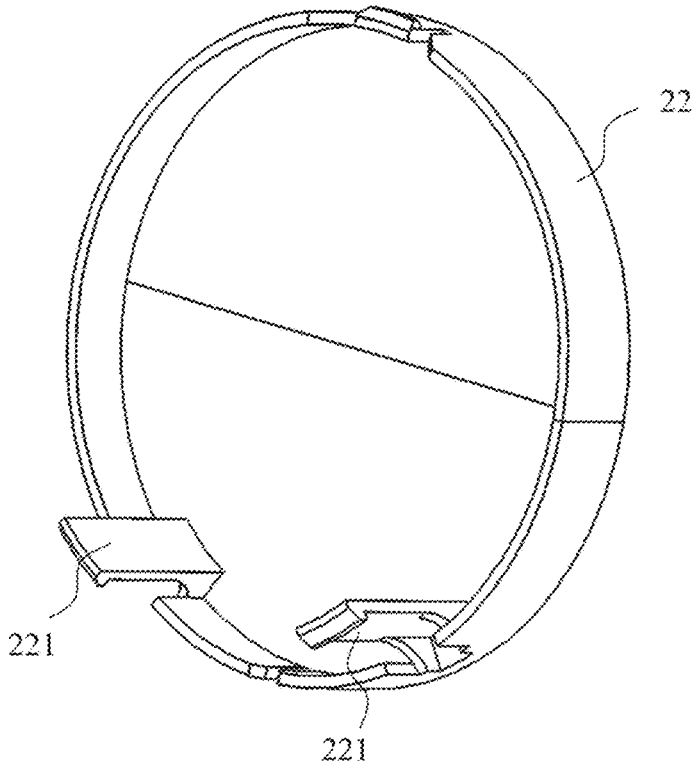
FIG. 9 is another perspective view of the cover according to at least one embodiment of the present disclosure.

The second interface component 2 includes a second housing 21 and a cover 22, the second housing 21 is configured to connect to a fan head 30 of the fan 100. For example, as shown in FIG. 7, the second housing 21 has a roughly U-shaped shape, a cylinder 212 and an opening 211 provided on the cylinder 212 are coaxially provided at two ends of the U-shaped shape to accommodate the rotation mechanism 3. The opening 211 is perpendicular to the second axis A2, the second axis A2 is also the rotation axis of the rotation mechanism 3. On one side opposite to the opening of the cylinder 212, an arm 213 is further provided to prevent the rotation mechanism 3 from coming out. The rotation mechanism 3 can pass through the opening 211 along the second axis A2 and be installed to the first housing 11 and/or the second housing 12. As shown in FIG. 8, the cover 22 has a circular disc shape and is provided with a buckle portion 221 on one side of the surface for clamping connection with the second housing 21, the cover 22 can cover the opening 211. Besides that, a second stop concave portion 82 can be provided on the wall 213, a function of the second stop concave portion 82 will be described in detail later.

FIGS. 1 and 2 show a connection component 10 after installation. It can be seen that the actuator 12 and the rotation mechanism 3 are fully accommodated in a space enclosed by the first housing 11, the second housing 21, and the cover 22, which is beautiful and has simple appearance.

Figure 3:
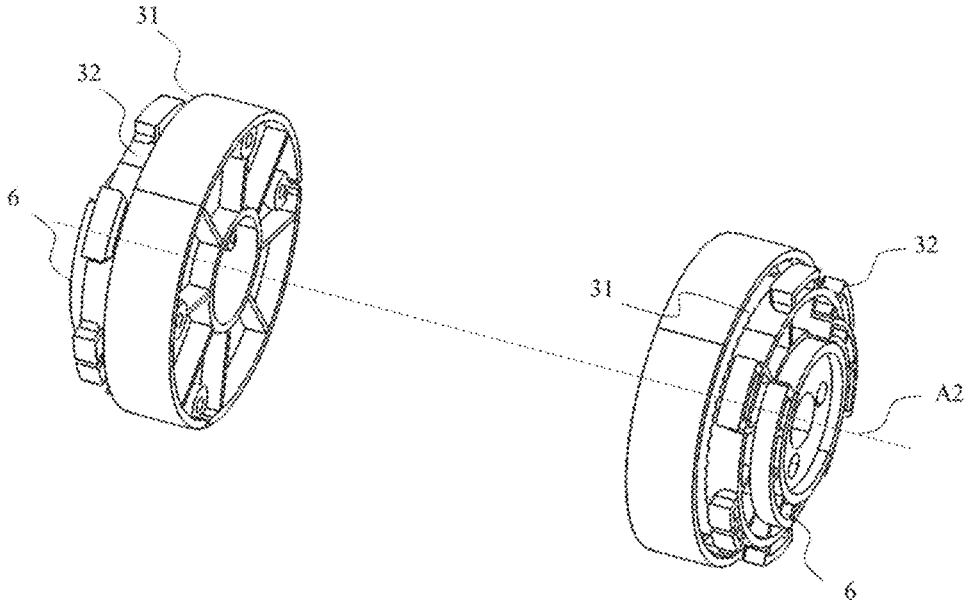
FIG. 3 is a perspective view of a rotation mechanism according to at least one embodiment of the present disclosure.
Figure 4:
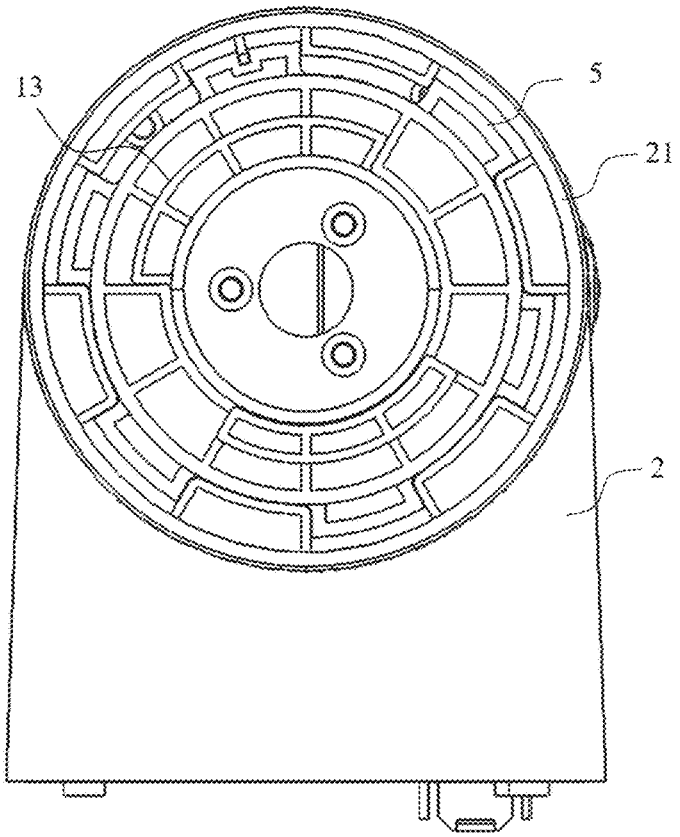
FIG. 4 is a side view of the connection component according to at least one embodiment of the present disclosure, where a cover of a second interface component is omitted.

As shown in FIG. 3, the rotation mechanism 3 includes the first mechanism 31 and the second mechanism 32, which are coaxially arranged along the second axis A2, the first mechanism 31 and the second mechanism 32 can rotate with each other along the second axis A2. In the present disclosure, the second axis A2 is perpendicular to the first axis A1. The first mechanism 31 is rotationally and fixedly connected to the first interface component 1, the second mechanism 32 is rotationally and fixedly connected to the second interface component 2, so that the first interface component 1 and the second interface component 2 can rotate with each other along the second axis. Therefore, the fan head 30 connected to the second interface component 2 can swing up and down (pitch) in the horizontal plane relative to the bracket 20 of the first interface component 1.

Unlike known devices that use dual motors to achieve a composite swing, the connection component 10 proposed in the present disclosure only requires the rotation mechanism 3 and one motor to achieve the composite swing such as up and down swing and left and right swing, which has a simple structure and low cost.

The following will describe the rotation mechanism 3 according to at least one embodiment of the present disclosure, in combination with FIGS. 4 to 24. The effects of the technical solution of the present disclosure will be reflected in the description.

The first mechanism 31 and the second mechanism 32 need to meet the following functions: first, they can rotate relative to each other, this rotation can be manually driven, or can also be driven by a motor; secondly, the contact between the first friction disc and the second friction disc can be maintained at any angle, thereby allowing for a relative fixation of the position between the fan head 30 and the bracket 20 within a rotatable angle range, without rotation or shaking. In addition, it is beneficial that the rotation between the first mechanism 31 and the second mechanism 32 can produce sound synchronously, which can provide a user with rotation feedback and experience.

In order to realize these functions, the first mechanism 31 and the second mechanism 32 of at least one embodiment of the present disclosure can be realized by using relatively rotatable friction discs that are in contact with each other.

Figure 19:
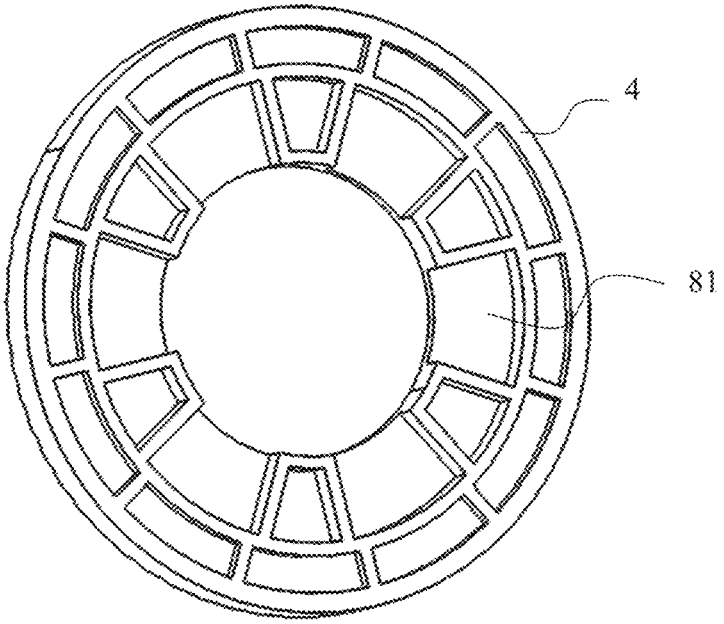
FIG. 19 is another perspective view of the first friction disc according to at least one embodiment of the present disclosure.
Figure 20:
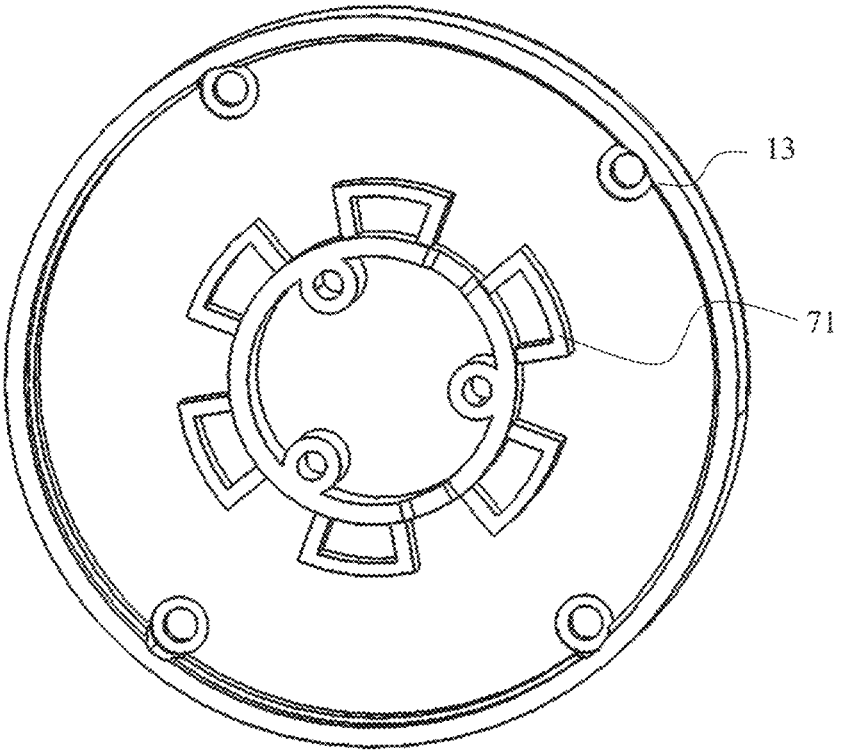
FIG. 20 is a perspective view of the intermediate connector according to at least one embodiment of the present disclosure.

Specifically, as shown in FIGS. 19 and 20, the first mechanism 31 can include a first friction disc 4, which is rotationally and fixedly connected to the first housing 11. The first friction disc 4 includes a first friction surface 41 and a first through-hole 42 distributed in a circumferential direction. The first friction surface 41 is provided on a surface of one side of the first friction disc 4 and is roughly distributed in a circular shape throughout the circumferential direction. Alternatively, the first friction surface 41 may only be distributed within a certain circumference angle range to limit the angle range of relative rotation of the first mechanism 31 and the second mechanism 32.

In this embodiment, the first friction surface 41 is non-planar, in an implementation mode, it is a tooth-shaped structure. The tooth-shaped structure can provide both damping and sound generation during rotation, therefore providing the user with a better interactive experience.

The first friction surface 41 can also be other non-planar structures, such as a procyclicality curved surface, such as a wavy surface, which has a uniform curvature change compared to a step change curvature of the tooth-shaped structure. The non-planar structures can further provide sound interaction during rotation.

Figure 5:
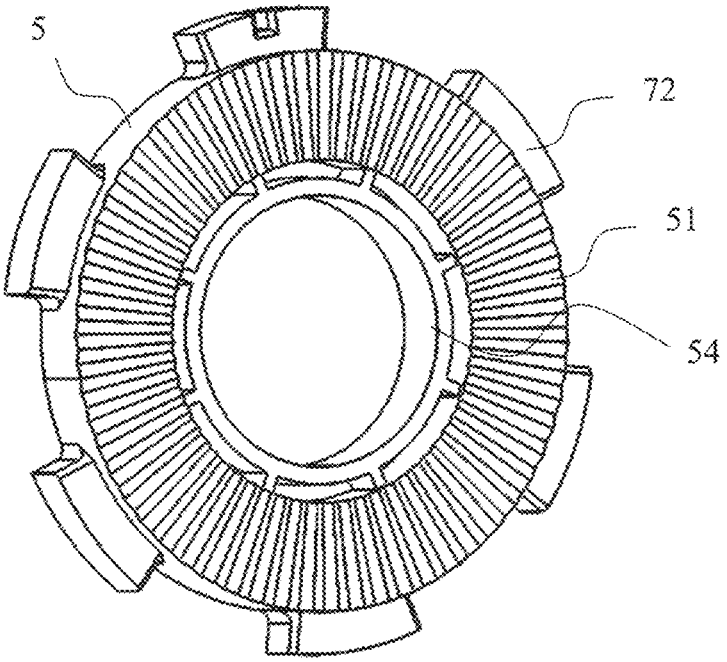
FIG. 5 is a perspective view of a second friction disc according to at least one embodiment of the present disclosure.
Figure 6:
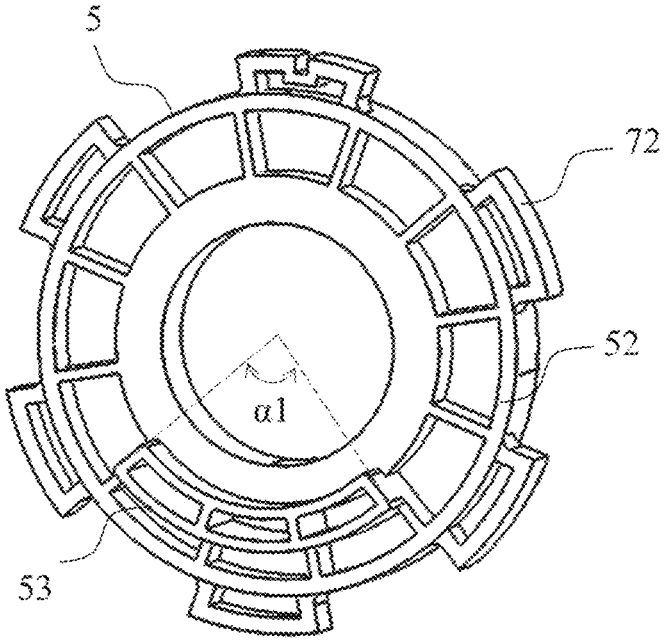
FIG. 6 is another perspective view of the second friction disc according to at least one embodiment of the present disclosure.

Accordingly, as shown in FIGS. 5 and 6, the second mechanism 32 can include a second friction disc 5, which includes a second friction surface 51 circumferentially distributed, a surface 52 opposite to the second friction surface 52, and a second through hole 54 penetrating the second friction surface 51 and the surface 52. The second friction surface 51 is in contact with the first friction surface 41 and can rotate relative to each other along the second axis A2.

In this embodiment, the second friction surface 51 is also non-planar, and having a tooth-shaped structure. The tooth-shaped structure can provide both damping and sound generation during rotation, thereby providing the user with a better interactive experience.

The second friction surface 51 can also be other non-planar structures, such as a procyclicality curved surface, such as a wavy surface, which has a uniform curvature change compared to the step change curvature of a tooth-shaped structure. The second friction surface 51 may have the same tooth-shape structure or other non-planar structure as the first friction surface 41.

Alternatively, the first friction surface 41 and the second friction surface 51 can also be planar structures with frictional damping, a frictional force between the first friction surface 41 and the second friction surface 51 allows for the contact between the first friction disc 4 and the second friction disc 5 to be maintained at any angle.

In this embodiment, the surface 52 of the second friction disc 51 may be provided with an angle limit portion 53, which protrudes from the surface 52 and extends circumferentially. The angle limit portion 53 can be in a sector shape and has a first circumferential angle $\alpha 1$.

The second friction disc 5 is rotationally and fixedly connected to the second housing 21, thereby transmitting a rotational motion of the second friction disc 5 to the second housing 21. Specifically, the second friction disc 5 is provided with multiple second stop convex portions 72 along a circumferential direction, the second stop convex portions 72 can be matched with multiple second concave portions 82 of the second housing 21 so that the second friction disc 5 is rotationally and fixedly connected to the second housing 21. Alternatively, the second stop convex portion 72 and the second stop concave portion 82 can also be oppositely provided on the second housing 21 and the second friction disc 5 respectively in a circumferential direction.

In a practical application, due to possible physical interference between the bracket 20, fan head 30 and the connection component 10, the rotation angle range of the first mechanism 31 relative to the second mechanism 32 is usually not complete 360 degrees. Therefore, in order to prevent an excessive rotation between bracket 20 and fan head 30, it is necessary to limit a rotation angle range of the rotation mechanism 3.

The first housing 11 adopts a revolved body shape, which allows for a larger range of rotatable angles between the first interface component 1 and the second interface component 2. In order to limit the rotation angle, an angle limit structure can be provided between the first mechanism 1 and the second mechanism 2.

Figure 23:
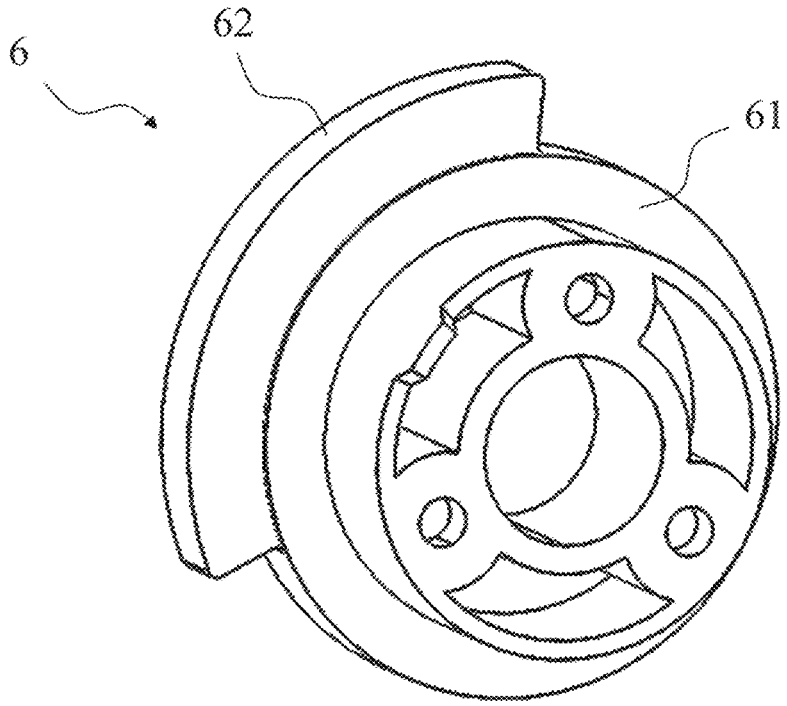
FIG. 23 is a perspective view of the angle limit member according to at least one embodiment of the present disclosure.
Figure 24:
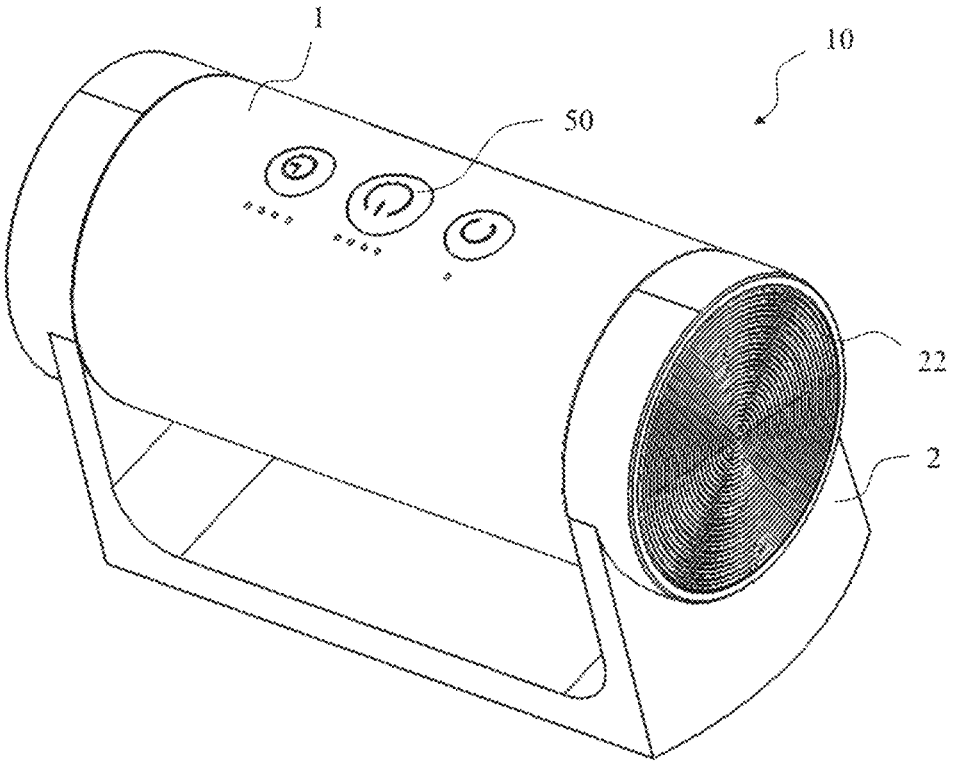
FIG. 24 is a perspective view of the connection component according to another embodiment of the present disclosure.

For example, as shown in FIGS. 23 and 24, the first mechanism 31 may include an angle limit member 6, which includes a main body 61 and a sector portion 62 extending in a circumferential direction of the main body 61. The sector portion 62 may have a second circumferential angle $\alpha 2$. The sector portion 62 and the angle limit portion 53 are provided in the same plane, in an implementation mode, provided within the same radius. The main body 61 can be fixedly connected to the first friction disc 4, for example, by a screw. Therefore, with a rotation of the first mechanism 31 and/or the second mechanism 32, the sector portion 62 of the angle limit member 6 can contact the angle limit portion 53 in two directions, such as clockwise or counterclockwise, respectively, and prevent further rotation, thereby limiting the rotatable angle of the connection component 1.

Figure 21:
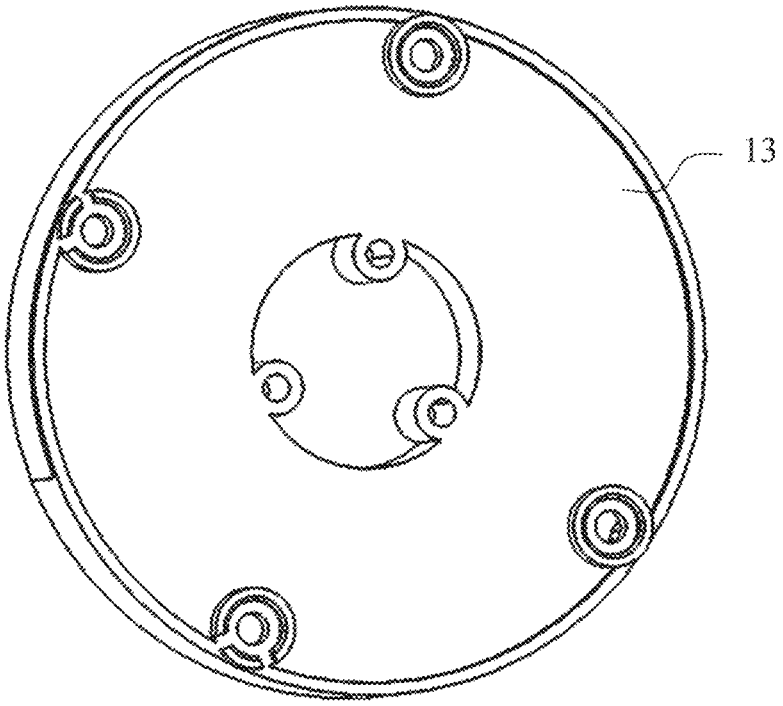
FIG. 21 is another perspective view of the intermediate connector according to at least one embodiment of the present disclosure.
Figure 22:
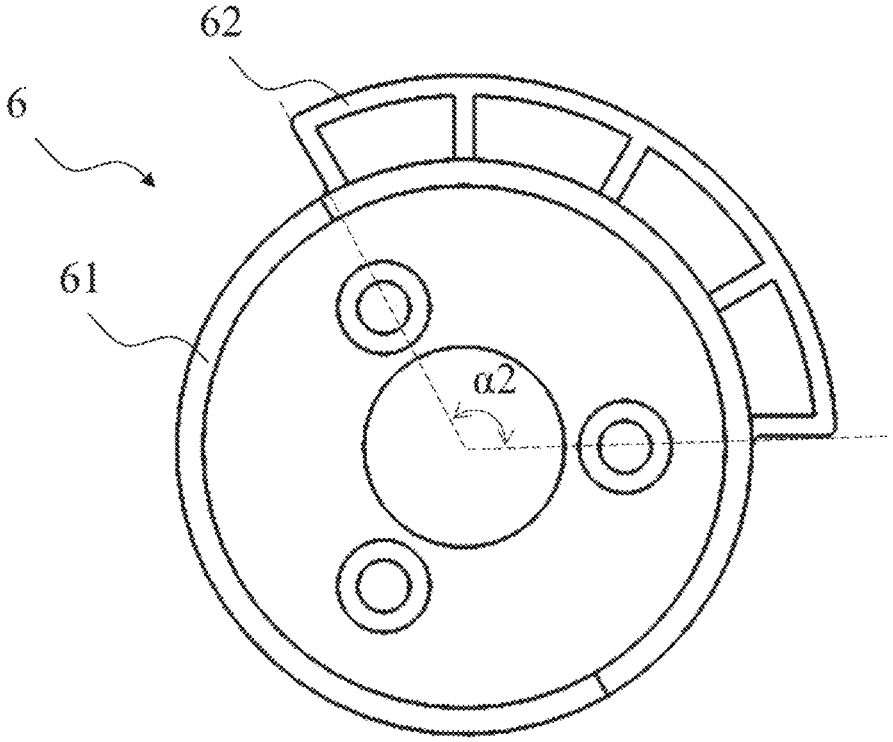
FIG. 22 is a front view of an angle limit member according to at least one embodiment of the present disclosure.

The present disclosure shows another embodiment of the angle limit member 6, as shown in FIGS. 21 and 22, the first mechanism 31 can further include an intermediate connector 13, which is fixedly connected with the first housing 11, for example, through a screw; and the intermediate connector 13 is rotationally and fixedly connected to the first friction disc 4. In this embodiment, the main body 61 of the angle limit member 6 is fixedly connected to the intermediate connector 13.

In order to achieve a rotational and fixed connection, the intermediate connector 13 can be provided with multiple first stop convex portions 71 along the circumference. Correspondingly, on one surface opposite to the intermediate connector 13, the first friction disc 4 can be provided with multiple first stop concave portions 81 in a circumferential direction that are matched with multiple first stop convex portions 71 for rotating and fixing connection with the intermediate connector 13.

Alternatively, the first stop convex portion 71 and the first stop concave portion 81 can also be oppositely provided in the circumferential direction of the intermediate connector 13 and the first friction disc 4.

Figure 12:
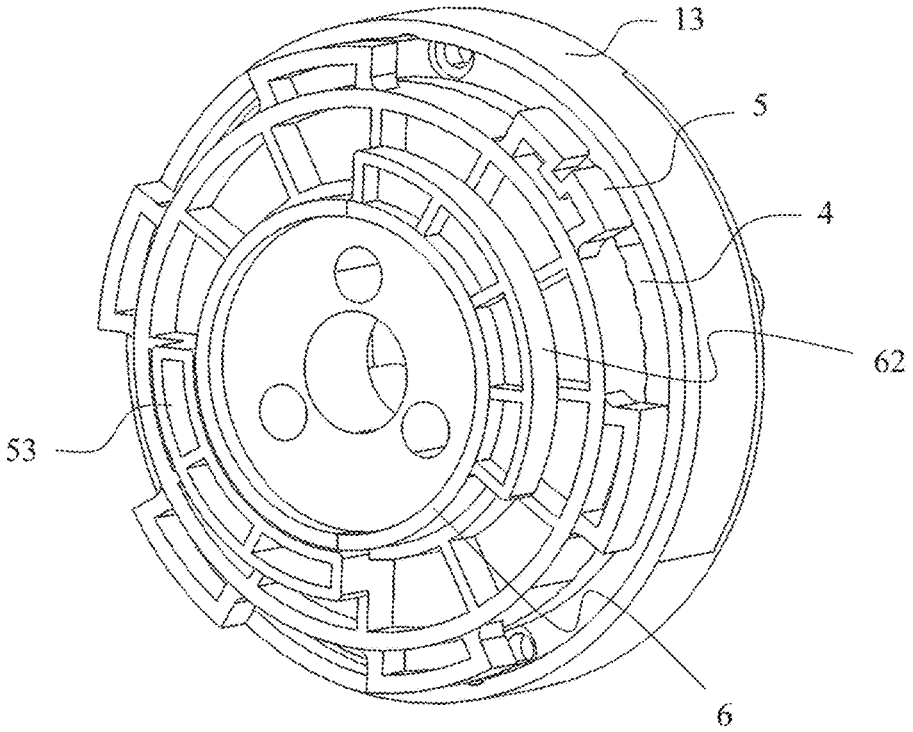
FIG. 12 is a perspective view of the rotation mechanism according to at least one embodiment of the present disclosure.
Figure 13:
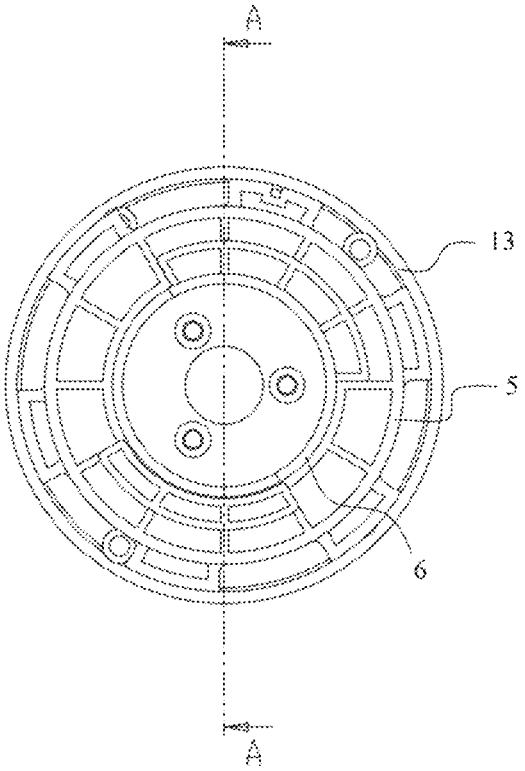
FIG. 13 is a front view of the rotation mechanism according to at least one embodiment of the present disclosure.
Figure 14:
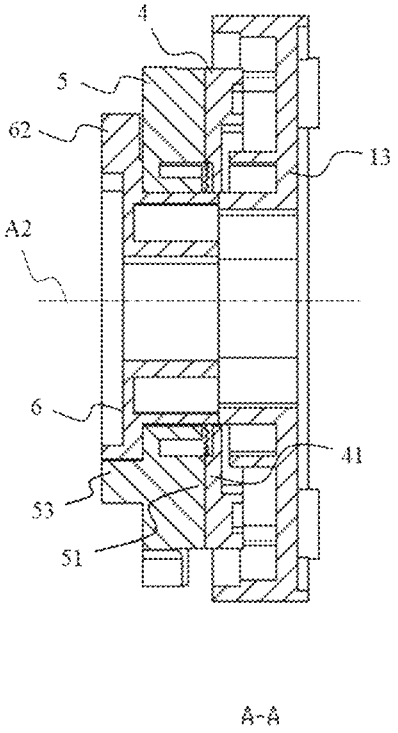
FIG. 14 is a cross-sectional view of the rotation mechanism taken along line A-A of FIG. 13.

FIGS. 12 to 14 exemplarily illustrate a schematic of a mutual cooperation between the first mechanism 31 and the second mechanism 32. In an axial direction along the second axis A2, the angle limit member 6, second friction disc 5, first friction disc 4, and intermediate connector 13 are tightly arranged in sequence. The intermediate connector 13 can abut against the wall 213 of the second housing 21, the angle limit member 6 can be pressed by the cover 22 to maintain a compression force in an axial direction, so that the first friction disc 4 and the second friction disc 5 are in close contact and prevent slipping.

As shown in FIG. 14, the main body 61 of the angle limit member 6 can sequentially pass through the first through hole 42 of the first friction disc 4 and the second through hole 54 of the second friction disc 5, and make the sector portion 62 and the angle limit portion 53 in the same plane and radius position.

Alternatively, inspired by the concept of the present disclosure, those skilled in the art may easily think about alternative embodiments of the angle limit structures. For example, the angle limit portion 53 is provided on the first friction disc 4 (instead of the second friction disc 5), the rotation angle is limited by a fit between the angle limit member 6 and the angle limit portion 53.

Figure 15:
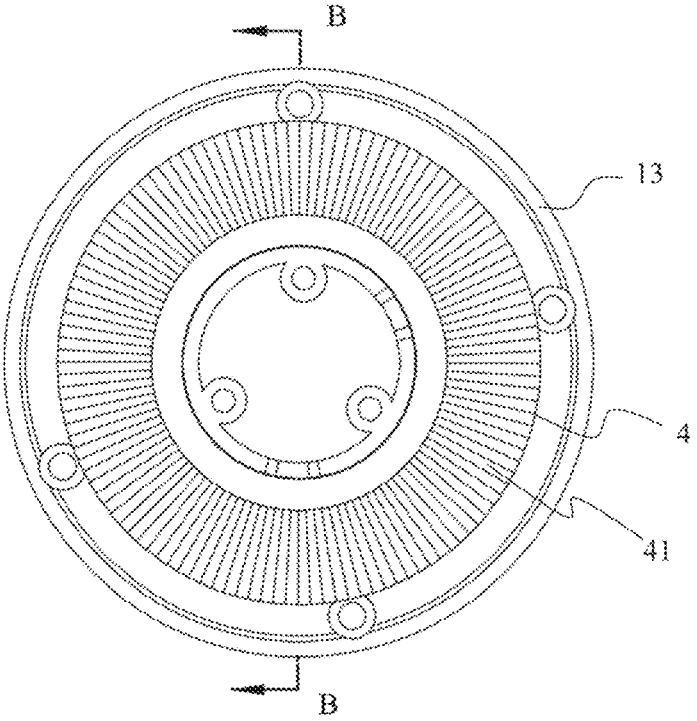
FIG. 15 is a front view of an intermediate connector and a first friction disc according to another embodiment of the present disclosure, where an elastic reset member is provided between the intermediate connector and the first friction disc.
Figure 16:
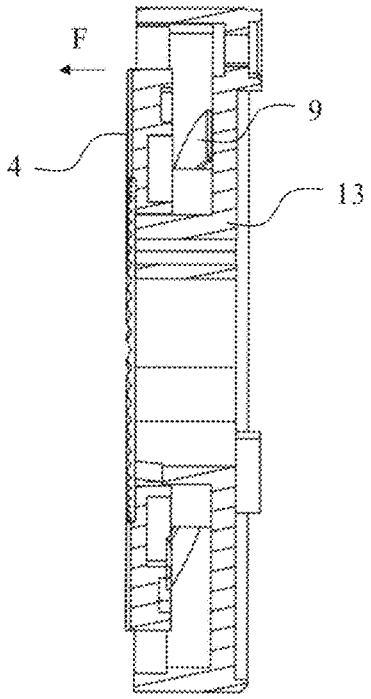
FIG. 16 is a cross-sectional view taken along line B-B of FIG. 15.
Figure 17:
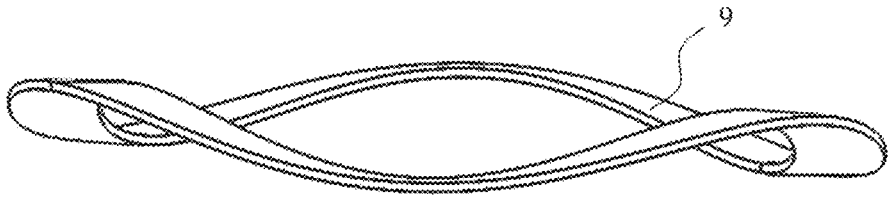
FIG. 17 is a perspective view of the elastic reset member according to at least one embodiment of the present disclosure.
Figure 18:
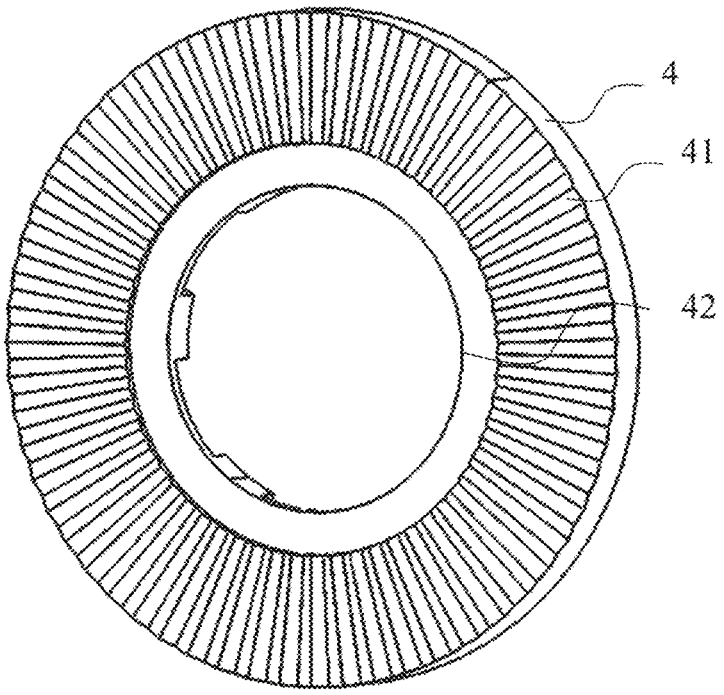
FIG. 18 is a perspective view of the first friction disc according to at least one embodiment of the present disclosure.

In order to maintain the close contact between the first friction disc 4 and the second friction disc 5, an elastic reset member 9 can be provided between the intermediate connector 6 and the first friction disc 4. Examples of this embodiment are exemplarily shown in FIGS. 15 to 17. As shown in FIGS. 15 and 16, the elastic reset member 9 applies a bias pressure F to the first friction disc 4 towards a direction of the second friction disc 5. As shown in FIG. 17, the elastic reset member 9 can be a wave shaped elastic gasket. The present disclosure is not limited to this. The elastic reset member 9 can also be a sheet spring, a torsion spring, a waveform spring, a plate spring, a disc spring, or a rubber elastic member.

Alternatively, in another embodiment not shown, an elastic reset member 9 can also be provided between the second friction disc 5 and the second housing 21, the elastic reset member 9 applies a bias pressure towards to the second friction disc 5 a direction of the first friction disc 4.

On the other hand, the present disclosure further proposes a fan 100, which includes a bracket 20, a fan head 30, and the connection component 10. The bracket 20 is connected to a first interface component 1, the fan head 30 is connected to a second interface component 2.

Figure 32:
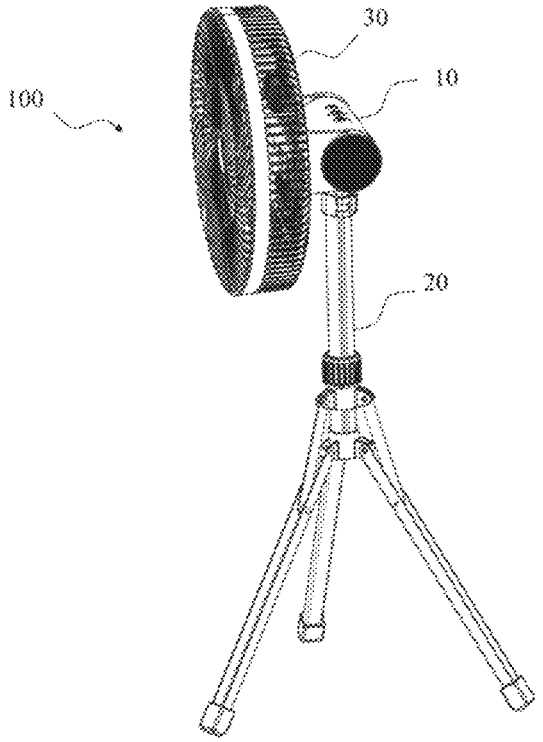
FIG. 32 is a perspective view of the fan according to still one embodiment of the present disclosure.
Figure 33:
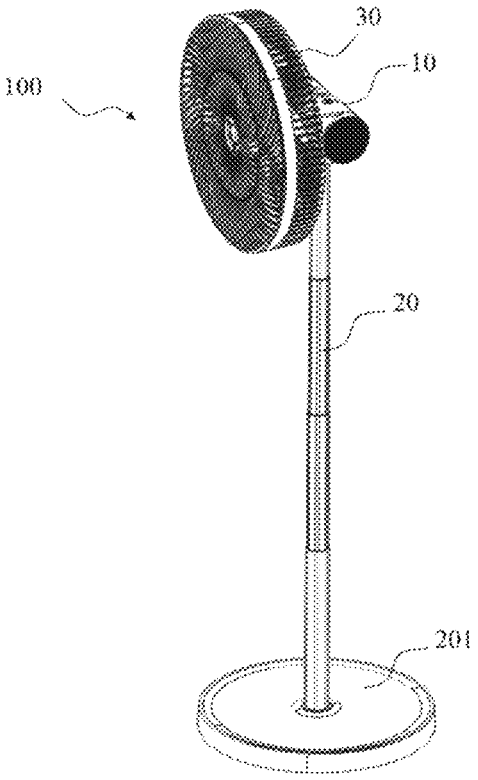
FIG. 33 is a perspective view of the fan according to yet one embodiment of the present disclosure.

In the embodiment shown in FIG. 26, the fan 100 can be a wall mounted fan, the base 201 of bracket 20 can be joined to the wall. In the embodiment shown in FIG. 32, the fan 100 is a vertical fan, the bracket 20 is a tripod for easy storage and portability. In the embodiment shown in FIG. 33, the fan 100 is a vertical fan, the base 201 of bracket 20 is placed on the ground.

FIGS. 26 to 31 exemplarily illustrate a state diagram of the fan 100 at an initial position and two extreme positions, a relative position diagram of the components of the first mechanism 31 and the second mechanism 32 at a corresponding position.

Firstly, as shown in FIG. 27, a third circumference $\alpha 3$ is formed between the angle limit portion 53 and the sector portion 62 of the angle limit member 6 along a first direction D1 (clockwise direction in the figure). A fourth circumference $\alpha 4$ is formed between the angle limit portion 53 and the sector portion 62 in a second direction D2 (counterclockwise direction in the figure) opposite to the first direction D1. From the figure, it can be seen that the first circumference $\alpha 1$, second circumference $\alpha 2$, third circumference $\alpha 3$ and the fourth circumference $\alpha 4$ will satisfy the following formula (I):

$$\alpha 1+\alpha 2+\alpha 3+\alpha 4=360^\circ \quad \text{(I)},$$

where the third circumference $\alpha 3$ defines a maximum angle that the second mechanism 32 can rotate in the first direction relative to the first mechanism 31, the fourth circumference angle $\alpha 4$ defines a maximum angle that the second mechanism 32 can rotate in the second direction relative to the first mechanism 31.

A large angle adjustment range is allowed between the fan head 30 and bracket 20, such as the third circumference angle α3 can be within a range of 30° to 120°, the fourth circumference α4 is within a range of 10° to 90°.

The third circumference α3 and the fourth circumference α4 can be the values within the above range according to actual needs. For example, the third circumference α3 can be 90°, the fourth circumference α4 can be 60°. Once the third circumference α3 and the fourth circumference α4 are determined. According to formula (I), it can be concluded that α1+α2=210° (II), and then, the first circumferential angle α1 is given and the second circumference α2 can be set according to need. For example, in this embodiment, the first circumference α1 is 90°, then the second circumference α2 is 120°. One angle in the first circumference α1 and the second circumference α2 can be chosen arbitrarily under a premise of satisfying formula (II), and the other angle can also be determined.

FIG. 27 shows an initial position of the connection component 10. The definition of the initial position can be such that the fan head 30 is in a roughly horizontal position, at this time, the fan head 30 can supply air in a horizontal direction, as shown in FIG. 26.

Figure 28:
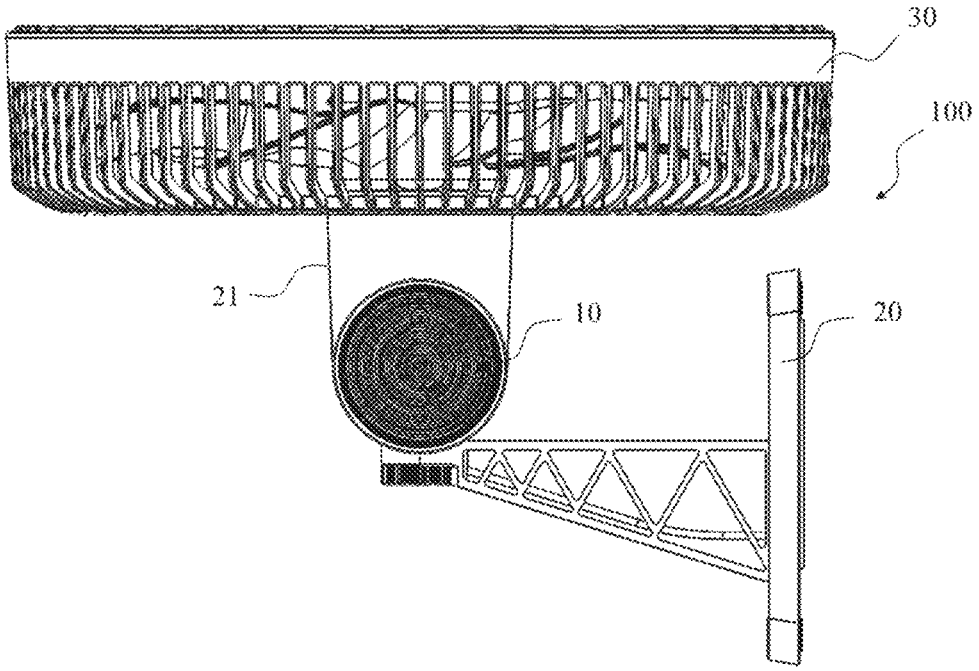
FIG. 28 is a perspective view of the fan according to at least one embodiment of the present disclosure, where the second mechanism is located at a first extreme position where it rotates in a first direction.
Figure 29:
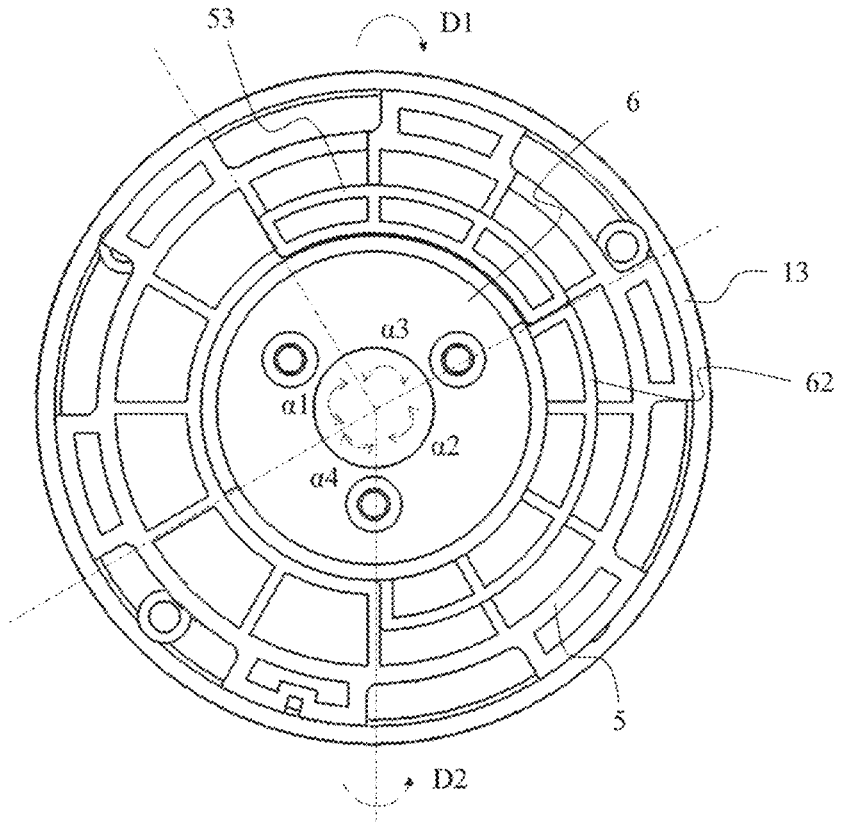
FIG. 29 is a schematic diagram of a relative position of the first mechanism and the second mechanism at the position shown in FIG. 28.

When it is necessary to change the angle of the air supply, the fan head 30 or the second housing 21 can be turned clockwise as shown in FIG. 26 to flip the fan 30 upwards. At this time, the fan head 30 and the second housing 21 rotate relative to the first housing 11, so that the second mechanism 32 rotates relative to the first mechanism 31. Specifically, the angle limit portion 53 shown in FIG. 27 finally rotates in the first direction D1 until it contacts the sector portion 62, at this time the second mechanism 32 reaches a first extreme position where it rotates in the first direction D1, as shown in FIG. 29. In this embodiment, the third circumference α3 is 90°, so the fan head 30 can rotate 90° to fully vertical upwards, as shown in FIG. 28.

Figure 30:
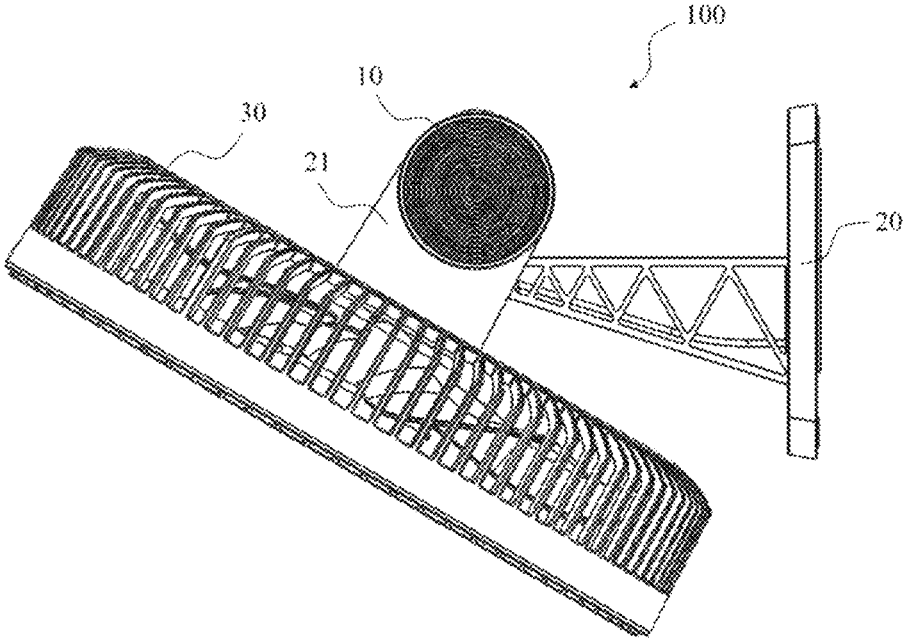
FIG. 30 is a perspective view of the fan according to at least one embodiment of the present disclosure, where the second mechanism is located at a second extreme position where it rotates in a second direction.
Figure 31:
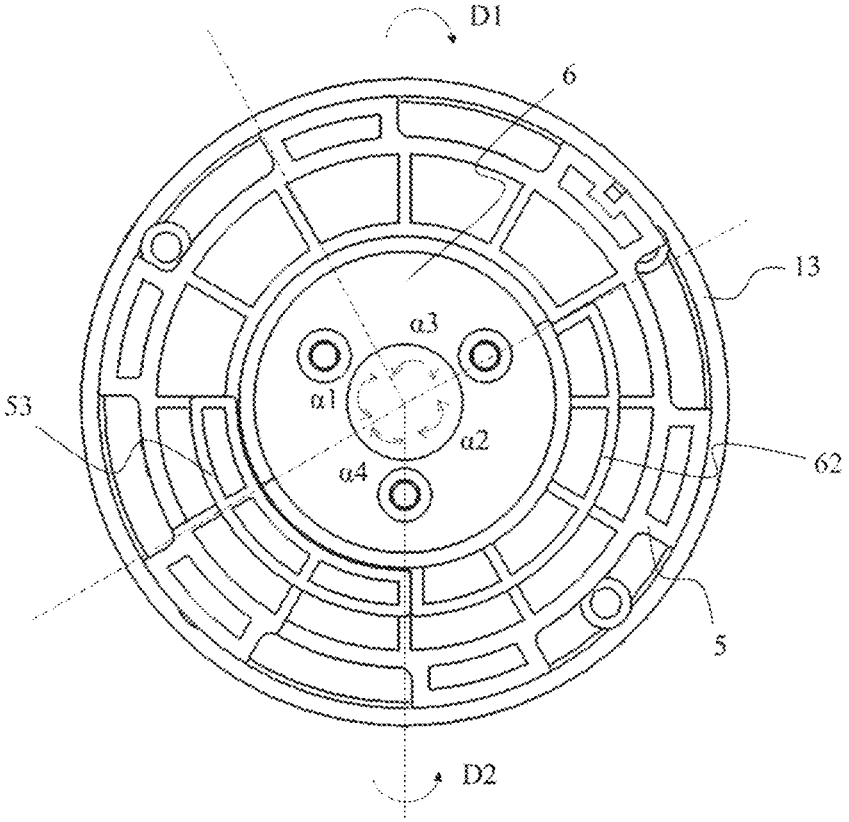
FIG. 31 is a schematic diagram of a relative position of the first mechanism and the second mechanism at the position shown in FIG. 30.

On the contrary, the fan head 30 or the second housing 21 can also be turned counterclockwise as shown in FIG. 26 to flip the fan 30 downwards. Finally, the angle limit portion 53 shown in FIG. 27 rotates in the second direction D2 until it contacts the sector portion 62, at which time the second mechanism 32 reaches a second extreme position where it rotates in the second direction D2, as shown in FIG. 31. In this embodiment, the fourth circumference α4 is 60°, so the fan head 30 can rotate downwards by 60°, as shown in FIG. 30.

Therefore, the fan 100 including the connection component 10 proposed in the present disclosure, can achieve up and down swing and left and right swing with a large swing angle range, simple structure, and compact size.

The exemplary embodiments of the connection component and fan proposed in the present disclosure have been described in detail with reference to the embodiments in the specification. However, those skilled in the art can understand that multiple variations and modifications can be made to the specific embodiments without departing from the principles of the present disclosure. In addition, various technical features and structures proposed in various aspects of the present disclosure can also be combined in multiple ways, without beyond the protection scope of the present disclosure, which is determined by the attached claims.

NUMBER REFERENCE

1 First interface component
11 First housing
12 Actuator
13 Intermediate connector
2 Second interface component
21 Second housing
211 Opening
212 Cylinder
213 Wall
22 Cover
221 Buckle portion
3 Rotation mechanism
31 First mechanism
32 Second mechanism
4 First friction disc
41 First friction surface
42 First through hole
5 Second friction disc
51 Second friction surface
52 Surface
53 Angle limit portion
54 Second through hole
6 Angle limit member
61 Main body
62 Sector portion
71 First stop convex portion
72 Second stop convex portion
81 First stop concave portion
82 Second stop concave portion
9 Elastic reset member
10 Connection component
20 Bracket
201 Base
30 Fan head
40 Actuator
50 Button
100 Fan
A1 First Axis
A2 Second Axis
D1 First Direction
D2 Second Direction
α1 First circumference angle
α2 Second circumference angle
α3 Third circumference angle
α4 Fourth circumference angle

What is claimed is:

1. A connection component for a fan, comprising:

a first interface component, which comprises a first housing and an actuator accommodated within the first housing, wherein the actuator is configured to connect to a bracket of the fan and capable of rotating relative to the first housing along a first axis;

a second interface component, which comprises a second housing configured to connect a fan head of the fan; and a rotation component, which comprises a rotating member and a protruding portion that can rotate with each other along a second axis, the second axis is perpendicular to the first axis, wherein the rotating member is rotationally and fixedly connected to the first interface component and the protruding portion is rotationally and fixedly connected to the second interface component so that both the first interface component and the second interface component are capable of being rotated along the second axis;

wherein the rotating member and the protruding portion are arranged coaxially along the second axis, wherein the rotating member comprises a first friction disc, the first friction disc comprises a first friction surface that is circumferentially distributed; the protruding portion comprises a second friction disc, the second friction disc comprises a second friction surface that is circumferentially distributed; the first friction surface and the second friction surface are in contact with each other and can rotate relative to each other along the second axis, wherein the first friction disc is rotationally and fixedly connected to the first housing, the second friction disc is rotationally and fixedly connected to the second housing.

2. The connection component according to claim 1, wherein the first friction surface and the second friction surface are a planer surface, a frictional force between the first friction surface and the second friction surface allows the first friction disc and the second friction disc to maintain contact at any angle; or the first friction surface and the second friction surface are a non-planar surface, the non-planar surface comprises a tooth-shaped structure or a procyclicality curved surface.

3. The connection component according to claim 1, wherein the rotating member further comprises an intermediate connector, which is fixedly connected with the first housing and rotationally and fixedly connected to the first friction disc.

4. The connection component according to claim 3, wherein one of the first friction disc and the intermediate connector is provided with at least one first stop convex portion along a circumference, the other of the first friction disc and the intermediate connector is provided with at least one first stop concave portion that matches the at least one first stop convex portion along the circumference, and/or one of the second friction disc and the second housing is provided with at least one second stop convex portion along a circumference, the other of the second friction disc and the second housing is provided with at least one second stop concave portion that matches the at least one second stop convex portion along the circumference.

5. The connection component according to claim 3, wherein an elastic reset member is provided between the intermediate connector and the first friction disc, the elastic reset member applies a bias pressure on the first friction disc towards a direction of the second friction disc, or an elastic reset member is provided between the second friction disc and the second housing, the clastic reset member applies a bias pressure on the second friction disc towards a direction of the first friction disc, wherein the elastic reset member is an elastic gasket.

6. The connection component according to claim 1, wherein the second friction disc is provided with an angle limit portion on a surface opposite to the second friction surface, the angle limit portion protrudes from the surface and extends circumferentially; the angle limit portion has a first circumferential angle $\alpha 1$, the rotating member further comprises an angle limit member, which comprises a main body and a sector portion extending along a circumference of the main body; the sector portion and the angle limit portion are arranged in a same plane; the main body is fixedly connected with the first friction disc, wherein the sector portion has a second circumferential angle $\alpha 2$.

7. The connection component according to claim 6, wherein a third circumferential angle $\alpha 3$ is formed between the angle limit portion and the sector portion in a first direction; a fourth circumferential angle $\alpha 4$ is formed between the angle limit portion and the sector portion in a second direction opposite to the first direction;

wherein the third circumferential angle $\alpha 3$ defines a maximum angle that the protruding portion can rotate relative to the rotating member in the first direction, the fourth circumferential angle $\alpha 4$ defines a maximum angle that the protruding portion can rotate relative to the rotating member in the second direction.

8. The connection component according to claim 7, wherein the third circumferential angle $\alpha$ is within a range of 30° to 120°, the fourth circumferential angle $\alpha 4$ is within a range of 10° to 90°.

9. The connection component according to claim 7, wherein the first circumferential angle $\alpha 1$, the second circumferential angle $\alpha 2$, the third circumferential angle $\alpha 3$ and the fourth circumferential angle $\alpha 4$ satisfies the following relationship:

$$\alpha 1+\alpha 2+\alpha 3+\alpha 4=360°.$$

10. The connection component according to claim 1, wherein the first housing is formed by enclosing two shell halves.

11. The connection component according to claim 1, wherein the first housing is cylindrical, and there are two rotation components, each one of the two rotation components is provided at two opposite ends of the first housing, two ends of the second housing are rotationally and fixedly connected to the two rotation components, and the second housing is supported on the first housing by the two rotation components, the second housing comprises an opening, the two rotation components pass through the opening along the second axis and are installed to the first housing and/or the second housing, the second interface component further comprises a cover, and the cover has a clamping connection to the second housing and covers the opening.

12. A fan comprising the connection component according to claim 1, wherein the fan further comprises a fan head and a bracket; and the bracket is connected to the first interface component, the fan head is connected to the second interface component.

13. The connection component according to claim 1, wherein the first housing is a single piece as a whole.

* * * * *